US005172573A

United States Patent [19]

Sharp et al.

[11] Patent Number: 5,172,573

[45] Date of Patent: Dec. 22, 1992

[54] AUTOMATIC WASHER BASKET AND AGITATOR DRIVE SYSTEM

[75] Inventors: Brenner M. Sharp, St. Joseph Township, Berrien County; Douglas E. Wood, Hagar Township, Berrien County, both of Mich.

[73] Assignee: Whirlpool Corporation, Benton Harbor, Mich.

[21] Appl. No.: 791,798

[22] Filed: Nov. 13, 1991

[51] Int. Cl.[5] ..... D06F 23/04; D06F 37/40

[52] U.S. Cl. ..... 68/23.7; 192/89 A; 192/108

[58] Field of Search ..... 68/23.7; 192/89 A, 108

[56] References Cited

U.S. PATENT DOCUMENTS

| | | | |
|---|---|---|---|
| 1,254,372 | 1/1918 | Stanley . | |
| 2,130,855 | 9/1938 | Oliver | 74/368 |
| 2,185,109 | 12/1939 | Williams et al. | 68/133 |
| 2,298,905 | 10/1942 | Skinner | 68/23 R |
| 2,398,570 | 4/1946 | Wildhaber | 192/68 |
| 3,224,535 | 12/1965 | Herbkersman | 192/67 |
| 3,433,337 | 3/1969 | Salter | 192/46 |
| 3,743,067 | 7/1973 | Bokovoy | 192/43 |
| 4,155,228 | 5/1979 | Burgener, Jr. et al. | 68/133 |
| 4,255,952 | 3/1981 | Johnson | 68/23.7 |
| 4,291,556 | 9/1981 | Mason | 68/23.7 |
| 4,317,343 | 3/1982 | Gerry | 68/23.7 |
| 4,969,341 | 11/1990 | Burk et al. | 68/23.7 |

*Primary Examiner*—Philip R. Coe
*Attorney, Agent, or Firm*—Stephen D. Krefman; Thomas J. Roth; Thomas E. Turcotte

[57] ABSTRACT

A clutch mechanism for the drive system of an automatic washer having a concentrically mounted wash basket, and a motor drivingly connected to the agitator to drive the basket. The clutch mechanism includes a first clutch member drivingly connected to the motor, and a second clutch member drivingly connected to the wash basket and selectively axially actuable for driving engagement with the first clutch member. Opposing engagement surfaces of the clutch members are provided with alternating radially extending splines and grooves having a generally sawtooth profile. The splines of one of the clutch members are provided with squared tips, and the grooves of the other clutch member are provided with squared recesses, so that the shape of the corresponding splines and recesses provide an easily achieved yet secure connection when the clutch members are drivingly engaged. The splines and grooves are so configured to provide clearance for smooth engagement without regard to small variations in tooth size or misalignment, and is such that rattling during steady state spin operation is eliminated.

6 Claims, 3 Drawing Sheets

FIG. 5
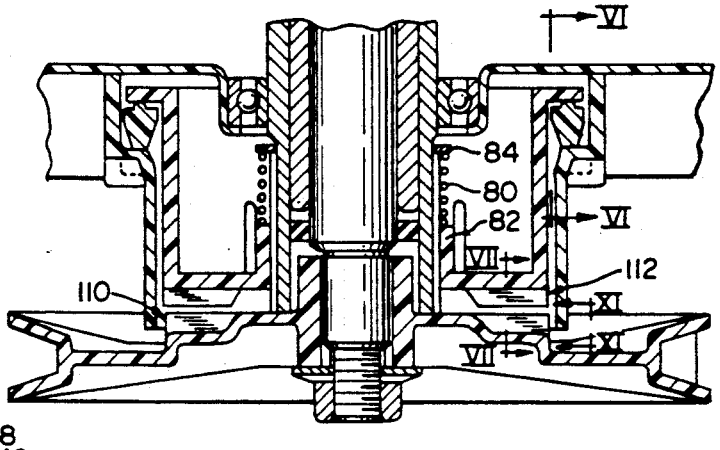
FIG. 8
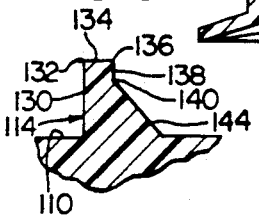
FIG. 7
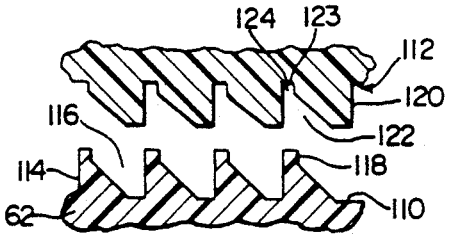
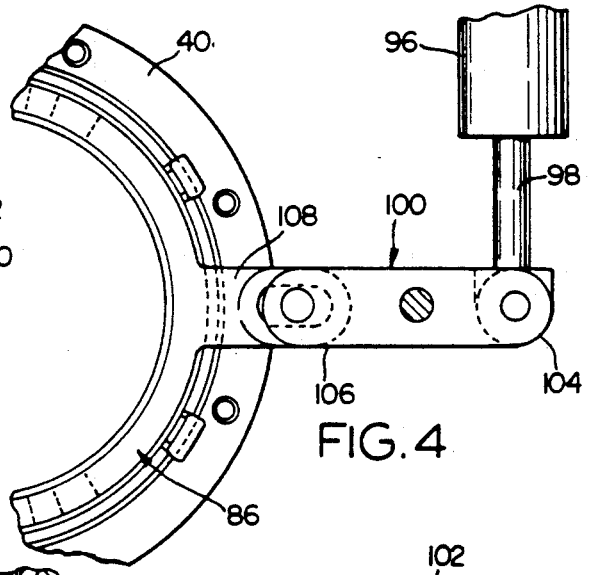
FIG. 4
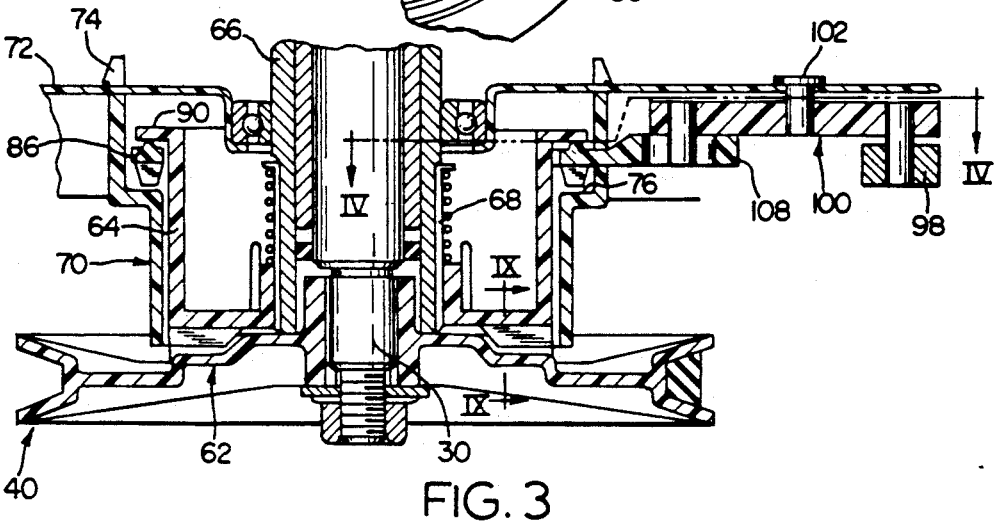
FIG. 3

AUTOMATIC WASHER BASKET AND AGITATOR DRIVE SYSTEM

BACKGROUND OF THE INVENTION

The present invention relates to drive systems for automatic clothes washers, and more particularly to improvements in a clutch mechanism to be incorporated in a vertical axis washer having a planetary drive system.

Automatic washers having a direct drive system between the motor and agitator/wash basket require a clutch mechanism so that the washer will be able to selectively operate in a agitate mode, wherein the agitator is oscillated while the basket is held stationary, and in a water extraction or "spin" mode, wherein the agitator and basket are spun together. Conventional machines utilizing this drive system incorporate a spring clutch or a spline clutch with a solenoid to actuate the clutch, moving the clutch member vertically on the motor shaft to selectively engage or disengage a drive connection with the wash basket.

Spring clutch mechanisms use a wrap spring clutch, in which the torsional tension in a coil spring encircling a drive shaft is varied such that the coil spring selectively grips or idles on the shaft. In this matter, the motor drive shaft is coupled to the wash basket drive system. Wrap spring clutches are typically expensive due to the tolerances and process controls required for reliable operation.

Previously known spline clutch and solenoid mechanisms are usually complicated arrangements, requiring precisely machined mating surfaces and complicated actuation mechanisms. The complexity of such arrangements renders them relatively expensive and unreliable.

U.S. Pat. No. 4,969,341 issued to Burk et al. on Nov. 13, 1990, teaches a clutch mechanism in the drive system of an automatic washer. This clutch system is a spline and solenoid clutch mechanism similar to the clutch mechanism contemplated in this application. Burk describes a solenoid operated cam, clutch slider engagement means connected to the basket and a clutch plate engagement means connected to the motor. Engagement of the clutch slider with the clutch plate is controlled by the solenoid actuated cam. A resilient member urges the clutch slider into the clutch plate. The profile of the splines is a combination sawtooth and square tooth profile, but is such that during engagement of the clutch plate and clutch slide, collisions may occur between the splines of the clutch means and the complimenting groove of the other clutch means during steady state spin such that unacceptable rattling may occur. The object of the present invention is to provide a tooth profile which will eliminate rapid collisions between the splines and grooves of the clutch members which causes unacceptable rattling. It should be noted that U.S. Pat. No. 4,969,341, was issued less than one year prior to the filing date of the present application and is assigned to the same assignee as the present application.

SUMMARY OF THE INVENTION

The present invention contemplates a cam actuated clutch mechanism for use in an automatic washer having a vertical axis agitator, a concentrically mounted wash basket, and a motor drivingly connected to the agitator to selectively oscillate or rotate the agitator about a vertical axis. The clutch mechanism selectively drivingly connects the wash basket with the motor for simultaneous rotation of the agitator and the wash basket during a spin cycle.

In an exemplary embodiment, the clutch mechanism includes first and second clutch members, with the second clutch ember being drivingly connected to the wash basket and selectively actuable to drivingly engage the first clutch member. A stationary cam housing is located adjacent to the second clutch member, and a rotatable ring is disposed between the cam housing and the second clutch member. Cam surfaces are located between the rotatable ring and the cam housing, such that rotational movement of the ring is translated into axial movement of the second clutch member.

The clutch mechanism further includes a resilient member for biasing the second clutch member towards engagement with the first clutch member, and an actuation mechanism for producing rotary motion of the rotatable ring.

The clutch members have opposed planar engagement surfaces, each of which includes a series of alternating radial splines and grooves. During engagement of the first and second clutch members, the splines of each of the clutch members are received in the grooves of the other clutch member. In the embodiment illustrated, the splines of the first clutch member have squared tips at their peaks, and the grooves of the second clutch member include corresponding squared troughs for receiving the squared tips.

The spline profile is a hybrid between a square tooth profile and sawtooth profile. Square teeth have the advantage of secure engagement since, once the parts are engaged, the teeth cannot slip backwards past one another. However, square teeth are difficult to engage, since the parts must be perfectly aligned. This presents a severe problem when the parts are moving prior to their engagement, as is the case in washing machines clutches. A sawtooth profile is easier to engage, since the tip of each spline has a greater chance to penetrate its opposing groove. However, a sawtooth spline is more likely to experience "backlash", where the teeth slip backwards past one another if the driving part decelerates slightly, such as when the motor is briefly de-energized as is common in washing machine operation.

The hybrid face splines have a predominantly sawtooth profile so that moving engagement is possible. The square peaks and corresponding recesses take advantage of the secure engagement of square teeth. However, the square recesses must be wider than the corresponding square peaks to provide clearance or spacing which allows engagement of the clutch member without problems due to square peak size deviations and square peak misalignment which may occur in standard manufacturing practices. Additionally, suitable clearance or spacing is required if dirt or foreign particle contamination between the clutch means is to be accommodated without interference. It is possible, however, to have two bumps placed opposite each other on the outside edge of the square tips to eliminate this spacing in two locations but would not create engagement problems as described above. Furthermore, means are provided to ensure contact between clutch members on the inclined surface of the sawtooth profile. This contact prevents rapid collisions between each square tip and each corresponding square recess which may occur during steady state spin and which may cause objectionable rattling. A spring or other resilient member is provided between the clutch members to completely drive the splines into their opposing grooves. After the squared tip enters the square recess, the splines are prevented from slipping backwards past one another, thus eliminating "backlash".

Other objects and advantages of the present invention will become apparent upon reference to the accompanying description when taken in conjunction with the following drawings.

BRIEF DESCRIPTION OF THE DRAWING

FIG. 3 is a side section view of the clutch assembly of the present invention in its engaged position.

FIG. 4 is a top view partially broken away taken along line IV—IV of FIG. 3.

FIG. 5 is a side sectional view of the clutch assembly of the present invention shown in its disengaged position.

FIG. 7 is a sectional view taken generally along line VII—VII of FIG. 5.

FIG. 8 is a detailed view of one of the splines of FIG. 7.

DESCRIPTION OF THE PREFERRED EMBODIMENT

Figure 1:
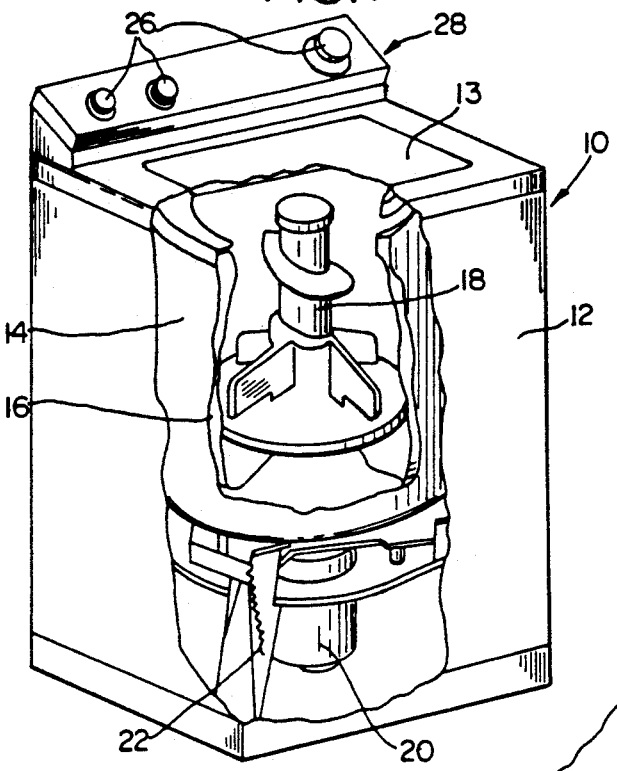
FIG. 1 is a perspective view of an automatic washer embodying the principles of the present invention.

In FIG. 1 there is illustrated an automatic washer generally at 10 embodying the principles of the present invention. The washer has an outer cabinet 12 with an openable lid 13 which encloses an imperforate wash tub 14 for receiving a supply of wash liquid. Concentrically mounted within the wash tub is a wash basket 16 for receiving a load of materials to be washed and a vertical axis agitator 18. A motor 20 is provided which is drivingly connected to the agitator 18 to drive it in an oscillatory or rotary manner, and is also selectively connectable to the basket 16 for simultaneous rotation with the agitator 18. The assembly of the tub 14, wash basket 16, agitator 18, and motor 20 is mounted on a suspension system 22. A plurality of controls 26 are provided on a control console 28 for automatically operating the washer through a series of washing, rinsing, and liquid extracting steps.

Figure 2:
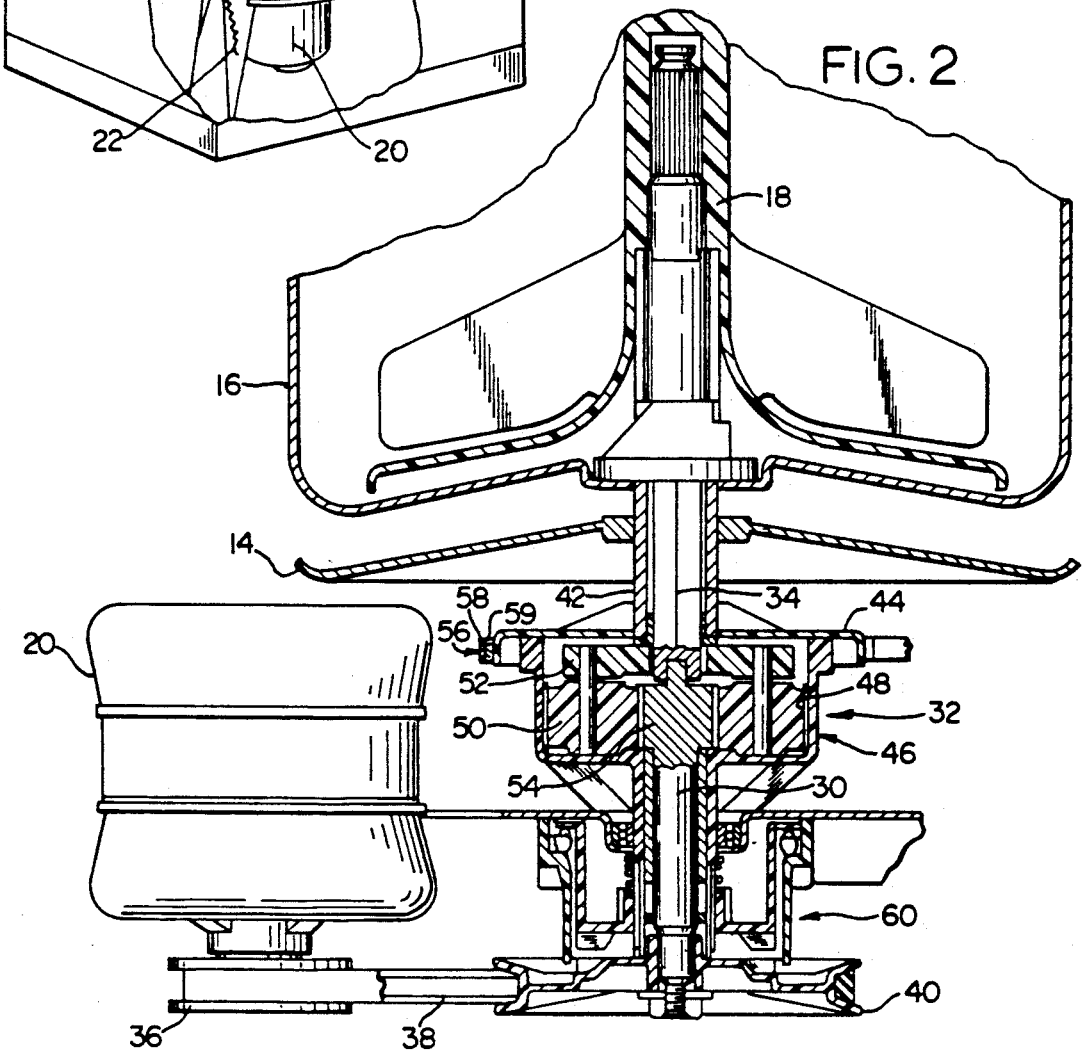
FIG. 2 is a side section view of the agitator and drive system of the washer of FIG. 1.

The drive mechanism is shown in greater detail in FIG. 2, where it is seen that the motor 20 is connected through a drive shaft 30 to a gear arrangement, such as a planetary gear assembly 32, and to a vertical shaft 34 connected to the agitator 18. In this particular drive arrangement, the motor 20 may be a permanent split capacitor (PSC) motor, and is connected through a drive pulley 36 and a belt 38 to drive a driven pulley 40 affixed to the bottom of the drive shaft 30. The motor 20 may be reversely operated to provide oscillatory motion to the agitator. The wash basket 16 is connected to a spin tube 42, which is in turn connected to a hub surface 44 of a gear housing 46. The gear housing 46 includes an outer gear ring 48 which interacts with a plurality of planet gears 50. The vertical shaft 34 is connected to the planet gears 50 through the use of a connecting carrier plate 52, and a sun gear 54 is directly connected to the drive shaft 30.

When the washer is operating in the agitate mode, the motor 20 is operated in a reversing fashion which causes the drive shaft 30 to oscillate, thus driving the sun gear 54 in alternating opposite directions. The agitator 18 is therefore oscillated through its connection with the planet gears 50. The wash basket is held stationary during this operation, and to provide the means for holding the basket stationary, a band brake mechanism shown generally at 56 may be provided. The band brake mechanism 56 includes a brake band 58 having a high friction interior lining 59 which is engageable with at least a portion of the circumference of the hub 44 connected to the basket 16. The band brake 56 may be constructed and actuated as disclosed in commonly assigned and copending U.S. application Ser. No. 214,592, filed Jul. 1, 1988, the specification of which is incorporated by reference herein.

Generally, in the agitate mode, the agitator 18 is oscillated through an angle of approximately 270° to 300° during each stroke. Often, it is desirable to hold the wash basket fixed relative to the wash tub during the agitate mode. This is accomplished by leaving the brake mechanism 56 in an "on" condition. However, during the water extraction step, the basket 16 is spun with the agitator 18. During this step the brake mechanism 56 is released from frictional engagement with the hub 44.

A clutch mechanism is required to provide a way of switching between oscillatory movement of the agitator relative to the basket, and spinning of the agitator with the basket. The present invention contemplates an improved and simplified clutch assembly 60, as shown in FIGS. 3 through 8. The clutch assembly 60 includes a clutch plate 62 integrated into the surface of the driven pulley 40, and a clutch slider 64. The clutch slider 64 is mounted for vertical movement on a cylindrical portion 66 of the gear housing 46 by means of vertical splines 68. A stationary cam housing 70 concentrically surrounds the clutch slider 64, and its secured to a mounting plate 72 of the washer 10 by a plurality of retaining tabs 74. The cam housing 70 also includes an inner annular rim 76 upon which are mounted a plurality of cam surfaces, shown in FIG. 6 as angularly spaced upwardly directed ramps 78. The clutch slider 64 is biased toward engagement which the clutch plate 62 by a spring or other resilient or elastic member 80, shown in FIG. 5 as being retained concentrically surrounding the cylindrical portion 66, between an inner cylinder 82 of the clutch slider 64 and a clip-ring spring abutment 84.

Figure 6:
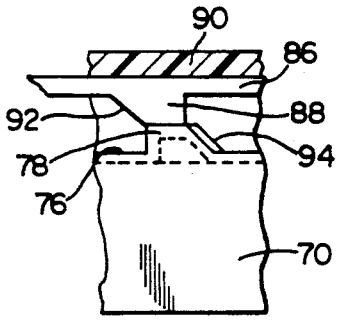
FIG. 6 is a section view taken generally along line VI—VI of FIG. 5.

A rotatable ring 86, upon which are mounted angularly spaced, downwardly directed cam followers 88, is disposed between the annular rim 76 of the cam housing 70 and an abutment edge 90 of the clutch slider 64. Rotation of the ring 86 causes inclined surfaces 92 of the cam followers 88 to slide along inclined surfaces 94 of the cam housing 70 (FIG. 6). This rotation causes axial displacement of the clutch slider 64, due to contact between the ring 86 and the abutment edge 90 of the clutch slider 64. Rotation of the ring 86 may be achieved by an actuator 96 (for example, a solenoid actuator), acting through an actuator rod 98 to pivot a linkage 100 about a pivot pin 102. One end 104 of the linkage 100 is connected to the actuator rod 98, while another end 106 of the linkage 100 is connected to a lever arm 108 of the rotatable ring 86. Operation of the actuator 96 pivots the linkage 100, thus rotating the ring 86 and axially is placing the clutch slider 64.

Details of opposed engagement surfaces 110 and 112 of the clutch plate 62 and the clutch slider 64 are best illustrated in FIGS. 7 and 8. The engagement surface 110 of the clutch plate 62 includes a series of radially extending alternating splines 114 and grooves 116 disposed on the surface thereof. The splines 114 are provided with squared peaks 118. The engagement surface 112 of the clutch slider 64 includes a corresponding series of radially extending alternating splines 120 and grooves 122. The grooves 122, at their inner most portions 123, include square recesses 124 which are proportioned such as to be wider than the squared peaks 118 of the splines 114. This difference in size creates excess space 166 and provides clearance and, therefore, allows for slight deviation in the size and dimensions of each spline and groove as would occur in standard manufacturing practices. This clearance also allows proper engagement between the clutch plate 62 and the clutch slider 64 when dirt or other particulate contamination comes between squared recesses 124 and squared peaks 118.

As can be seen in FIG. 8, each of the splines 114 includes a first surface 130 extending perpendicularly from the engagement surface 110 to a first predetermined point 132. A second surface 134 extends from the first predetermined point 132, parallel to the engagement surface 110, to a second predetermined point 136. A third surface 138 extends from the second predetermined point 136, downwardly toward the engagement surface 110 and parallel to the first surface 130, to a third predetermined point 140. A fourth surface 144 extends from the third predetermined point 140 outwardly and obliquely from the first surface 130, to the engagement surface 110.

Figure 11:
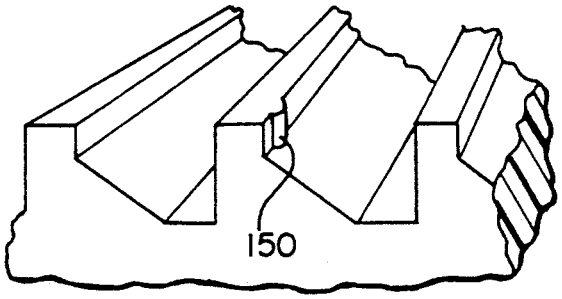
FIG. 11 is a perspective view of three of the splines of FIG. 7.

As shown in FIG. 11, the present invention further provides two bumps 160 located 180° apart on the splines of clutch plate 62. More specifically, the bumps 160 are located on surface 138 at spline 114. These two bumps 162 occupy the clearance space 158 in two locations but are such that they do not create an interference fit problem between the clutch plate 62 and the clutch slides 64 under standard manufacturing tolerances or in the presence of dirt.

Figure 9:
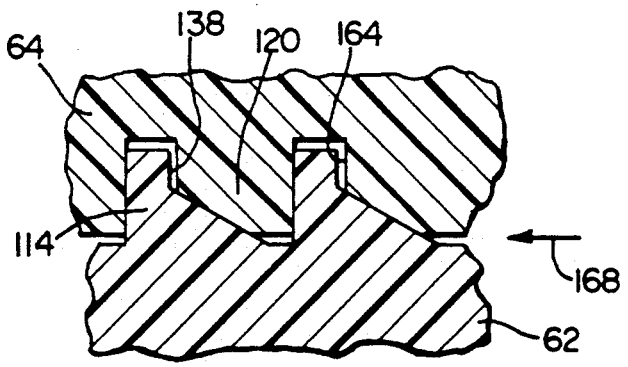
FIG. 9 is a sectional view taken generally along line IX—IX of FIG. 3 with motor in drive status.
Figure 10:
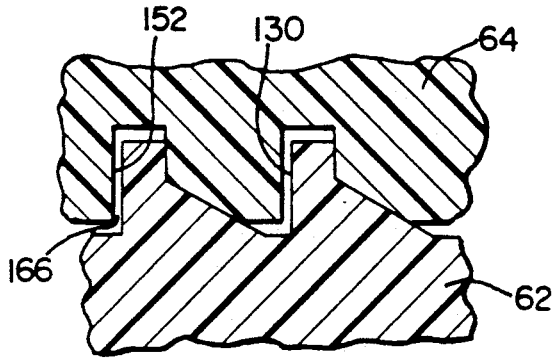
FIG. 10 is the same view as FIG. 9 with the motor in coast status.
Figure 12:
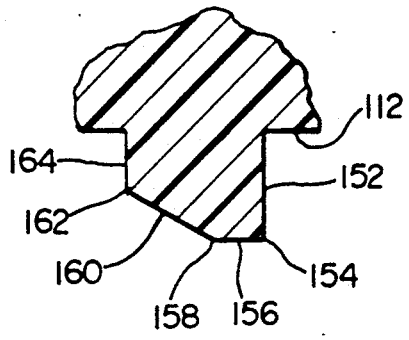
FIG. 12 is a detailed sectional view of the splines of FIG. 7.

As shown in FIG. 12, each of the splines 120 includes a first surface 152 extending perpendicular from engagement surface 112 to a first predetermined point 154. A second surface 156 extends from the first predetermined point 154, parallel to the engagement surface 112 to a second predetermined point 158. A third surface 160 extends from the second predetermined point 158 outwardly and obliquely from the first surface 152, to a third predetermined point 162. A fourth surface 164 extends from the third predetermined point 162, downwardly to the engagement surface 112 and parallel to the first surface 152. As illustrated in FIG. 9 and FIG. 10, the second surface 156 has a length greater than the width of groove 116, which is measured between two adjacent splines 114. Additionally, side 160 and 144 are inclined at the same angle so that contact can occur on these surfaces.

As can be seen in from FIG. 7, the grooves 122 of the clutch slider 64 generally correspond in shape to the splines 114 of the clutch plate 62, and the splines 120 of the clutch slider 64 generally correspond in shape to the grooves 116 of the clutch plate 62. As can be seen from FIG. 9 during driving engagement of the clutch plate 62 and the clutch slider 64 in direction 168, the resilient or elastic member 80 urges the clutch slider 64 downwardly so that splines 114 are received in grooves 122 and splines 120 are received in grooves 116.

The opposed engagement surfaces 110 and 112 are configured such that contact occurs along the surfaces 144 and 160, causing the clutch plate 62 and the clutch slider 64 to wedge together and establish contact along surface 130 and 152. As can be seen in FIG. 9 and FIG. 10, horizontal movement of the clutch plate 62 and the clutch slide 64 is accompanied by vertical movement of the clutch slider 64 due to the contact between inclined surfaces 144 and 160. This vertical movement is resisted by resilient or elastic member 80. This resistance to vertical movement of the clutch slider 64 provides stability to the engagement between the clutch plate 62 and the clutch slider 64 and prevents the square peaks 118 from rapidly moving back and forth in the excess space 166 during steady state portions of spin causing collisions between the square peaks, 118 and the square recesses 124 which would create an objectionable rattling noise. Additionally, bumps 150 occupy space 166 in two locations and further serve to reduce the collisions between the square peaks 118 and the square recesses 124 which may cause objectionable rattling. This arrangement provides an easily achieved yet secure engagement between the clutch members.

Although the present invention has been described with reference to a specific embodiment, those of skill in the art will recognize that changes may be thereto without departing from the scope and spirit of the invention as set forth in the appended claims.

The embodiments of the invention is which an exclusive property or privilege is claimed are defined as follows:

1. In an automatic washer having an agitator contained in a wash basket, a motor for driving said agitator and a clutch means selectively connectible between said motor and said wash basket, a clutch comprising:

first engagement means for transmitting power from said motor, said first engagement means including a plurality of radially extending evenly spaced first splines disposed on said first engagement means, each of said first splines further including:

a first side extending outwardly from an originating point to a first predetermined point;

a second side extending at an angle from said first side at said first predetermined point to a second predetermined point;

a third side extending from said second side at said second predetermined point to a third predetermined point, and forming an opposite-facing side to said first side;

a fourth side extending obliquely from said third side at said third predetermined point and terminating at the originating point of the adjacent spline;

second engagement means for transmitting power to said wash basket and engagable by said first engagement means being disposed adjacent to and facing said first engagement means, said second engagement means including a plurality of radially extending evenly spaced second splines disposed on said second engagement means, each selected pair of said second splines defining a facing surface therebetween, each of said second splines further including:

a first side extending outwardly from a first facing surface to a first predetermined point;

a second side extending at an angle from said first side at said first predetermined point to a second predetermined point, said second side being greater in length than an individual space between two of said adjacent first splines disposed on said first engagement means;

a third side extending obliquely from said second side at said second predetermined point to a third predetermined point, defining a plane parallel to the plane defined by said fourth side of one of said first splines which is adjacent during engagement;

a fourth side extending from said third side of said third predetermined point to a second facing surface;

each of said fourth sides being of sufficient length to prevent contact between each of said second sides of each of said first splines and each of said facing surfaces, during clutch engagement; and each of said facing surfaces having a width greater than the length of each of said second sides of said first splines.

2. An automatic washer according to claim 1, wherein said clutch means further comprises:

resilient means for biasing said second engagement means toward driving engagement with said first engagement means such that radial movement of the said first and second engagement means with respect to each other which may occur during steady state driving engagement will cause axial movement of the second engagement means and will be resisted by said resilient means.

3. An automatic washer according to claim 1, wherein said clutch means further comprises at least two bumps located opposite each other on said third side of said first spline which are opposite each other.

4. An automatic washer having a vertical axis agitator, a concentrically mounted wash basket, a motor drivingly connected to said agitator to selectively oscillate or rotate said agitator about said vertical axis, and a clutch means for selectively drivingly connecting said wash basket with said motor for simultaneous rotation of said agitator and said motor for simultaneous rotation of said agitator and said wash basket, said clutch means having a first engagement means drivingly connected to said wash basket and selectively axially actuable for driving engagement with said first engagement means, and means for selectively actuating said second engagement means into driving engagement with said first engagement means, wherein said clutch means further comprises:

a plurality of radially extending alternating first splines and first grooves disposed on said first engagement means and having a generally sawtooth profile;

a plurality of radially extending alternating second splines and second grooves disposed on said second engagement means and having a generally sawtooth profile;

a squared tip at a peak of each of said first splines; at least two bumps located on said square tips on said first spline which are located opposite each other; a squared recess, somewhat larger in width to said square peaks, at an innermost portion of each of said second grooves;

the spline and groove profile is so configured such that during driving engagement of said first and second engagement means, said first splines are received in said second grooves, and said first grooves receive said second splines.

5. An automatic washer according to claim 4, wherein said clutch means further comprises resilient means for biasing said second engagement means toward driving engagement with said first engagement means.

6. In an automatic washer having a vertical axis agitator, a concentrically mounted wash basket, a motor drivingly connected to said agitator to selectively oscillate or rotate said agitator about said vertical axis, and a clutch means for selectively drivingly connecting said wash basket with said motor for simultaneous rotation of said agitator and said wash basket, said clutch means having a first engagement means drivingly connected to said motor and a second engagement means actuable for driving engagement with said first engagement means, said first engagement means and said second engagement means defining parallel first and second opposed planar engagement surfaces, and means for selectively actuating said second engagement means into driving engagement with said first engagement means, wherein said clutch means further comprises:

radially extending alternating first splines and first grooves disposed on said first engagement means and having a generally sawtooth profile;

a squared tip at a peak of each of said first splines, said first spline further comprising:

a first side extending outwardly perpendicular to said engagement surface to a first predetermined point;

a second side extending parallel to said engagement surface form said first predetermined point to a second predetermined point;

a third side extending parallel to said first side from said second predetermined point toward said engagement surface to a third predetermined point; and a fourth side extending obliquely from said third predetermined point to said engagement surface;

said first groove being the space between the said first splines and having a width defined as the distance between the said first side of one said first spline and the said fourth side of second said first spine adjacent said one said first spline;

radially extending alternating second splines and second grooves disposed on said second engagement means and having a generally sawtooth profile, said second spline further comprising:

a first side extending outwardly perpendicular to said second engagement surface to a predetermined point;

a second side extending parallel to said second engagement surface to a second predetermined point, greater in length than said width of said firs groove;

a third side extending obliquely from said second predetermined point to a third predetermined point, similar in slope to said fourth side of said first spline; and a fourth side extending parallel to said first side from said third predetermined point to said second engagement surface of sufficient length to prevent contact between said second side of said first spline and said second engagement surface during clutch engagement;

a squared recess, wider than said square peaks, at an innermost portion of each of said second grooves;

said width of said squared recess at the innermost portion of each of said second grooves being the distance between the said first side of one said second spline and the said fourth side of an adjacent said second spline.

* * * * *